US006769487B2

(12) United States Patent
Hache

(10) Patent No.: US 6,769,487 B2
(45) Date of Patent: Aug. 3, 2004

(54) APPARATUS AND METHOD FOR ACTIVELY COOLING INSTRUMENTATION IN A HIGH TEMPERATURE ENVIRONMENT

(75) Inventor: Jean-Michel Hache, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1 day.

(21) Appl. No.: 10/248,016

(22) Filed: Dec. 11, 2002

(65) Prior Publication Data

US 2004/0112601 A1 Jun. 17, 2004

(51) Int. Cl.[7] ..... E21B 36/00

(52) U.S. Cl. ..... 166/302; 166/57; 62/259.2; 165/45

(58) Field of Search ..... 166/302, 57, 65.1; 62/451, 465, 466, 903, 259.2; 165/104.33, 143, 177, 104.21, 139, 45

(56) References Cited

U.S. PATENT DOCUMENTS

| | | | | |
|---|---|---|---|---|
| 2,671,323 A | | 3/1954 | Richert | |
| 2,711,084 A | | 6/1955 | Bergan | |
| 3,038,074 A | | 5/1962 | Scherbatskoy | |
| 3,435,629 A | | 4/1969 | Hallenburg | |
| 3,685,583 A | * | 8/1972 | Phares | 166/302 |
| 3,880,236 A | * | 4/1975 | Durning et al. | 166/302 |
| 4,248,298 A | | 2/1981 | Lamers et al. | |
| 4,287,957 A | * | 9/1981 | Evans | 175/17 |
| 4,375,157 A | | 3/1983 | Boesen | |
| 4,407,136 A | | 10/1983 | de Kanter | |
| 4,741,386 A | * | 5/1988 | Rappe | 165/45 |
| 5,265,677 A | | 11/1993 | Schultz | |
| 5,442,131 A | * | 8/1995 | Borgwarth | 174/15.6 |
| 5,539,853 A | * | 7/1996 | Jamaluddin et al. | 392/302 |

(List continued on next page.)

FOREIGN PATENT DOCUMENTS

| | | |
|---|---|---|
| EP | 0579392 A1 | 1/1994 |
| WO | WO 00/16118 | 3/2000 |
| WO | WO 00/45099 | 8/2000 |

OTHER PUBLICATIONS

Flores, Aaron G., Active Cooling for Electronics in a Wireline Oil–Exploration Tool, Engineering Report: Advanced Studies Engineering Report #7, May 30, 1996.

(List continued on next page.)

*Primary Examiner*—David Bagnell
*Assistant Examiner*—Daniel P Stephenson
(74) *Attorney, Agent, or Firm*—Victor H. Segura; Brigitte L. Jeffery; John Ryberg

(57) ABSTRACT

An apparatus and method are disclosed for actively cooling instrumentation, such as electronic circuits, in a downhole tool. This apparatus includes a compressor, condenser and expansion valve connected in circuit to an evaporator or heat exchanger. The evaporator/heat exchanger includes an inner container positioned about the instrumentation, and an outer chamber positioned about the inner container. A cooling fluid absorbs heat from the instrumentation as it passes through the inner container. The fluid then passes into the outer container where it may absorb heat from the wellbore. The heated fluid is then pressurized via the compressor, condensed into liquid via the condenser and selectively released back into the internal container upon cooling via the expansion valve. The fluid continuously circulates through the system whereby the instrumentation is insulated from heat and/or cooled.

28 Claims, 10 Drawing Sheets

U.S. PATENT DOCUMENTS

| | | | | | |
|---|---|---|---|---|---|
| 5,701,751 | A | | 12/1997 | Flores | |
| 5,720,342 | A | | 2/1998 | Owens et al. | |
| 5,829,519 | A | * | 11/1998 | Uthe | 166/60 |
| 5,862,866 | A | | 1/1999 | Springer | |
| 5,931,000 | A | * | 8/1999 | Turner et al. | 62/3.2 |
| 6,336,408 | B1 | | 1/2002 | Parrott et al. | |
| 6,341,498 | B1 | | 1/2002 | DiFoggio | |
| 6,434,972 | B1 | * | 8/2002 | Geiger et al. | 62/513 |
| 6,672,093 | B2 | | 1/2004 | DiFoggio | |
| 2002/0104328 | A1 | | 8/2002 | DeFoggio | |
| 2002/0148604 | A1 | | 10/2002 | Emeric et al. | |

OTHER PUBLICATIONS

Flores, Aaron, G., Active Cooling for Electronics in a Wireline Oil–Exploration Tool, MIT Thesis, Jun. 1996.

* cited by examiner

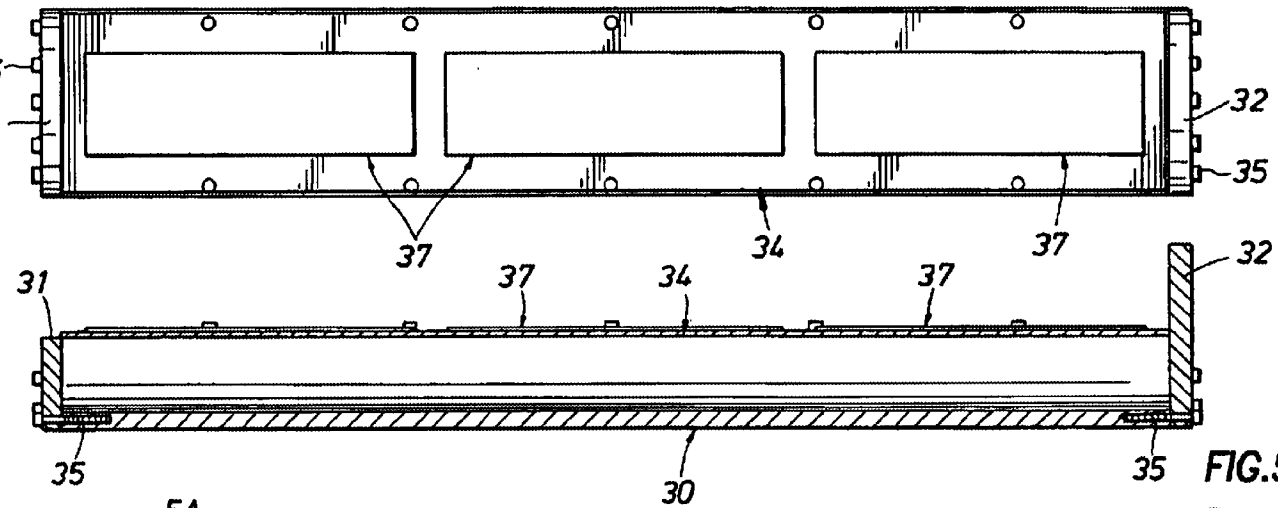
FIG.5A
Prior Art
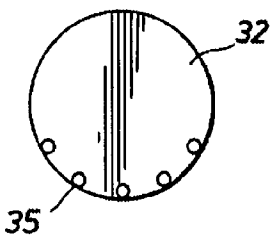
FIG.5D
Prior Art
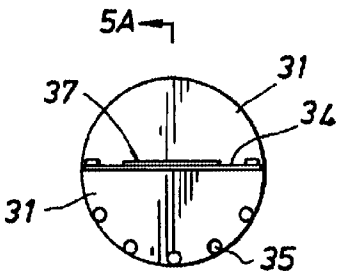
FIG.5C
Prior Art
Prior Art
FIG.5B

APPARATUS AND METHOD FOR ACTIVELY COOLING INSTRUMENTATION IN A HIGH TEMPERATURE ENVIRONMENT

BACKGROUND OF INVENTION

1. Field of the Invention

This invention relates to an apparatus and method for cooling Instrumentation in an apparatus exposed to high temperature environments. In particular, this invention relates to active cooling of instrumentation, such as electronics in a downhole tool positioned in a wellbore.

2. Background Art

The environment encountered by downhole oil exploration tools can be very severe. Temperatures up to and in excess of 200 degree C. and pressures up to $1.38\times10^8$ Pa are not uncommon. Consequently, producers of oil exploration tools must design robust tools that can operationally sustain these harsh conditions for extended lengths of time. Perhaps the most challenging of all conditions to design electronics that can reliably operate in high temperature environments. Standard electronic components are usually rated to operate only up to approximately 125 degree C. Thus, it becomes necessary to create or experimentally find electric components that can survive the high temperatures existing downhole. Since the components are constantly changing via new manufacturing techniques, updates, etc., this process of creating electronic components is expensive, time consuming, and never ending. In an effort to combat the high temperature requirement of electronics, the chassis or electronics compartments in downhole tools could be kept at or below 125 degree C.

Today, tools rated to 175 degree C. are sometimes inserted into Dewar Flasks when exploring boreholes in excess of 175 degree C. Dewar Flasks act to insulate the tool electronics and to slow the heating of the electronic chassis similar to a large "thermal bottle". The flask is a passive system that extends the downhole residence time of the tools by approximately four to six hours. Often the downhole residence times required for exploration are much greater than those offered by the expensive Dewar Flask system.

The problem at hand points toward the need for an active cooling system that can maintain the electronic chassis below 125 degree C. for extended lengths of time. Standard electronics could then be used without the need for the expensive high temperature components.

Active cooling systems already exist for a variety of applications such cooling food products, motor vehicles and buildings. These active cooling systems, better known as air conditioners and refrigerators, can effectively operate for extended periods of time with little to no maintenance. A cooling system makes heat move. It takes heat from one location and moves it to another location. The location from which heat was removed obviously becomes colder. For example, a refrigerator takes heat out of the inside and moves it to the outside. The heat flows into the air and the inside, having lost heat, becomes colder.

Vapor compression active cooling systems work by evaporation. When a liquid turns into a vapor, it loses heat and becomes cooler. This change is because the molecules of vapor need energy to move and leave the liquid. This energy comes from the liquid; the molecules left behind have less energy and so as a result, the liquid is cooler.

For an active cooling system to work continuously, the same cooling agent (etc., Freon) must be repeatedly used for an indefinite period. These cooling systems have three basic patterns: the vapor-compression system, the gas-expansion system and the absorption system. The vapor-compression system is typically more effective and is used more extensively than the other arrangements. The vapor-compression system consists of four main elements: an evaporator, a compressor, a condenser and an expansion device.

Referring to FIG. 1, in the evaporator 1, the cooling agent boils (evaporates) at a temperature sufficiently low to absorb heat from a space or medium that is being cooled. The boiling temperature is controlled by the pressure maintained in the evaporator, since the higher the pressure the higher the boiling point. The compressor 2 removes the vapor as it is formed, at a rate sufficiently rapid to maintain the desired pressure. This vapor is then compressed and delivered to a condenser 3. The condenser dissipates heat to circulating water or air. The condensed liquid cooling agent, which is now ready for use in the evaporator 1, is then sharply reduced in pressure by passing it through an expansion valve 4. Here, the pressure and temperature of the cooling agent drop until they reach the evaporator pressure and temperature, thus allowing the cooling cycle to repeat.

During expansion some of the liquid of the cooling agent flashes into vapor so that a mixture of liquid and flash vapor enters the evaporator. In a cooling system, the low pressure in the evaporator is set by the cooling temperature which is to be maintained. The high pressure maintained in the condenser is determined ultimately by the available cooling medium (e.g., the temperature of circulating water or the atmosphere air temperature). The process is one in which the cooling agent absorbs heat at a low temperature and then under the action of mechanical work, the cooling agent is compressed and raised to a sufficiently high temperature to permit the rejection of this heat. Mechanical work or energy supplied to the compressor as power is always required to raise the temperature of the system.

To further explain the cooling process, the four major components are examined in greater detail The evaporator 1 is the part of the cooling system in which the cooling is actually produced. The liquid cooling agent and vapor from the expansion valve 4 are introduced into the evaporator. As the liquid vaporizes, it absorbs heat at low temperature and cools its surroundings or the medium in contact with it. Evaporators may be direct expansion (acting directly to cool a space or product) or they may operate as indirect-expansion units to cool a secondary medium, such as water or a brine which in turn is pumped to a more distant point of utilization. A domestic refrigerator, for example, is a direct-expansion unit in that its evaporator directly cools the air in the food compartment and also directly contacts the water trays used for making ice. Evaporators vary greatly in design, with those used for cooling air often made as continuous pipe coils, with fins mounted outside the pipes to give greater surface contact to the air being chilled. For cooling liquid, such as a brine water, the shell and tube arrangement is common in this case, the brine passes through tubes surrounded by the boiling (evaporating) cooling agent, which is contained in a larger cylindrical shell. The brine tubes, in turn, are welded or rolled into tube sheets at the end of the shell to prevent leakage of the cooling agent from the shell or into the brine circuit.

The expansion valve 4 that feeds the evaporator must control the flow so that sufficient cooling agent flows into the evaporator for the cooling load but not in such excess that liquid passes over to the compressor, with the possibility of causing damage to it.

The compressor 2, the key element of the system, can be powered by means such as electric motor, steam or internal combustion engine, or steam or gas turbine. Most compressors are of the reciprocating (piston) type and range from the fractional-horsepower size, such as those found in domestic refrigerators or in small air-conditioning units, to the large multi-cylinder units that serve large industrial systems. In these large multi-cylinder units, capacity can be controlled with automatic devices that prevent the in certain cylinders from closing. For example, in a six-cylinder unit, if the valves are held open on two of the cylinders to keep them inoperative, the capacity of the machine is reduced by one-third when operating at normal speed.

Centrifugal compressors are used for large refrigeration units. These compressors employ centrifugal impellers that rotate at high speed. Centrifugal compressors depend for their compression largely on the dynamic action of the gases themselves as they flow in the diffusion passages of the compressor. These compressors can be large centrifugal compressors made with a single impeller or with two to four or more impellers in series, to compress the gas through the range required. These compressors are used extensively for large air-conditioning installations and also for usage in the industrial field when gases are compressed for liquefaction or for transportation, such as in the natural-gas industry, and when air is compressed to produce liquid oxygen or nitrogen.

The condenser 3 of a vapor system must dissipate heat from the hot vapor it receives from the compressor and condense this vapor to liquid for reuse by the evaporator. Condensers either dissipate heat to the ambient atmosphere through externally finned surfaces or by a shell and tube arrangement in which the vapor delivers heat to a circulating fluid (etc.: water) that passes through tubes contacting the cooling agent vapor. The temperature of the vapor is kept above that of the circulating water or air by compression to insure that heat is transferred to the coolant; thus, when the vapor is allowed to expand, its temperature drops well below that of the cooling agent.

Double-pipe condensers are also used. In such units, the cooling agent vapor and condensate pass in one direction through the annular space between the two tubes, while the water, flowing in the opposite direction through the central tube, performs the cooling function.

The air conditioning concept works on the principle of exchanging heat from a heated substance to a cold substance. In this principle, the temperature from a hot substance (such as a fluid) is transferred to a cold fluid. As the temperature of the hot fluid decreases, the temperature of the cold fluid increases. Heat exchangers are manufactured in many different designs and are used extensively in various industries. Heat exchangers are given different names when they serve a special purpose. Thus boilers, evaporators, superheaters, condensers and coolers may all be considered heat exchangers.

An example of a heat exchanger is illustrated in FIG. 2*a* and explains the basic operation of a heat exchanger. This exchanger is constructed from two pipes 7 and 8 in a concentric arrangement. Inlet and exit pipes 5, 6 are provided for the two fluids. In the sketch, the cold fluid flows through the inner tube 7 and the warm fluid via inlet pipe 5 in the same direction through the annular space between the outer and the inner tube. This flow arrangement is called parallel flow. In it heat is transferred from the warm fluid through the wall of the inner tube (the so-called heating surface) to the cold fluid. The temperature in both fluids varies as shown in FIG. 2*b*. In plot 9, the temperature of the warm fluid decreases from $t_{\omega 1}$to $t_{\omega 2}$. In plot 10, the temperature of the cold fluid increases from $t_{c1}$ to $t_{c2}$.The amount of heat Q that is transferred from one fluid to the other per unit of time, called heat flow, can be calculated from the following equation: Q=m c ($t_2t_1$)(1)This equation states that the heat flow Q(kW) can be obtained by multiplying the mass per unit of time of fluid m(kg/sec) by the specific heat c(KJ/kg-degree C.) of the fluid and by the temperature increase $t_1-t_2$ (degree C.) of the fluid entrance to the exit of the heat exchanger. The specific heat is a property of the fluid involved and its current state. The amount of heat leaving the warm fluid must be the same as the amount of heat received by the cold fluid. The mass flow and the temperature increase for the cold or the decrease for the warm fluid can therefore be entered into equation (1). The heat exchanger may have to be designed, for example, to increase the temperature of a prescribed mass per unit time $m_2$ of cold fluid from $t_{c1}$ to $t_{c2}$. Entering these value into equation (1) then determines the heat flux Q which has to be transferred in the heat exchanger. This value will be needed in the following discussion to calculate the heating surface of the exchanger.

The temperature difference $\Delta t_1$ between the fluids at the entrance of the heat exchanger decreases to the value $\Delta t_2$ at the exit, as illustrated in FIG. 2*a*. A heat exchanger is operated in counterflow when the direction of one of the fluids is reversed. The counterflow arrangement has the advantage that the exit temperature $t_{c1}$ of the colder fluid can be increased beyond the exit temperature $t_{\omega 2}$ of the warm fluid. In addition, a smaller surface area is required in counterflow than in parallel flow to transfer the same amount of heat. This is so because the mean temperature difference $\Delta t_m$ in the counterflow heat exchanger, for a given heat flux and prescribed inlet temperatures, is higher than in the parallel-flow exchanger.

The heating surface of the heat exchanger can be obtained from the equation:

$$A = \frac{Q}{U \Delta l_m} \tag{2}$$

The equation indicates that the required surface area A ($m^2$) is obtained by dividing the heat flux Q obtained with equation (1) by the overall heat transfer coefficient U and the mean temperature difference $\Delta t_m$ (degree C.). Larger heat exchangers utilize a bundle of tubes through which one of the fluids flows. The tubes are enclosed in a shell with provisions for the other fluid to flow through the spaces between the tubes. Fluid flowing outside the tubes can be directed either in the same direction as or counter to the effective flow in the tube bundles. In the latter arrangement, parallel or counter flow can be approximated in the way shown in FIG. 2*a*. In another arrangement, the cold fluid is distributed in such a manner that it flows in parallel through the tubes forming the heating surface and is then collected by a header. This arrangement creates a cross flow, as shown schematically in FIG. 2*a*. In nuclear reactors, fuel rods may replace the tubes, and the cooling fluid flowing around the rods removes the heat generated by the fission process. In a similar way, rods containing electric resistance heaters may supply heat to the fluid passing through the exchanger between the rods.

As previously mentioned, there is a need for a downhole cooling system that can keep downhole tool electronics cool in order to avoid tool failure from the extreme downhole temperatures. There have been attempts to apply the refrigeration concept to downhole tools. In 1977, Mechanics Research attempted to develop a system that incorporated a refrigeration technique for use in a geothermal well. The system design was to be a closed system that would operate continuously, similar to the refrigerator cooling concept of FIG. 1. However, the specific objective of the project was to develop a compressor for such a system. The project did not achieve its chief objectives.

Other techniques have also been developed to provide cooling for electronics. For example, U.S. Pat. No. 5,701,751 to Flores, assigned to the assignee of the present invention, provides a system for actively cooling instrumentation in a high temperature environment. This patent uses a hot heat exchanger 13, cold heat exchanger 12 and a compressor 11 to pump fluids through a downhole tool to cool the instrumentation. It is, however, limited in its maximum operating time, since it is based on a once through cycle, without the capability to re-circulate the fluid. As electronics are now used for extended durations in the drilling environment and in other newly instrumented downhole operations, the performance needs of the cooling system must increase. It is, therefore, desirable to provide a system capable of one or more of the following advantages (among others): continuous operation, reduced or eliminated time constraints, cooling of electronics to lower regulating temperatures, active cooling of electronics, insulation of electronics, added protection from outside elements, cooling over extended periods of time, layered protection and/or cooling of instrumentation, and cooling systems compatible with high temperature wellbore operations.

SUMMARY OF INVENTION

An active cooling system for downhole operations is provided. In one aspect, the present invention relates to an apparatus for actively cooling instrumentation contained in a downhole tool. The apparatus comprises a compressor, a condenser, an expansion valve and a heat exchanger (or evaporator). The compressor pressurizes a cooling fluid. The condenser is in fluid communication with the compressor and is capable of converting the cooling fluid from vapor into liquid. The expansion valve is in fluid communication with the condenser and is capable of selectively releasing the cooling fluid. The heat exchanger is adapted to receive the cooling fluid from the expansion valve and return the cooling fluid to the compressor. The heat exchanger comprises an inner container positioned about the instrumentation, and an outer container positioned about the inner container. The inner container is in fluid communication with the expansion valve, and the outer container is in fluid communication with the inner container and the compressor. The cooling fluid is cooled as it flows through the compressor, condenser and expansion valve, and absorbs heat as it passes through the inner and outer containers whereby the instrumentation remains cool in another aspect, the invention relates to a method for cooling instrumentation in a downhole tool. The method comprises pressurizing a cooling fluid, condensing the pressurized cooling fluid, passing a cooling fluid through an inner container positioned about the instrumentation, and passing the cooling fluid through an outer container disposed about the inner container.

In yet another aspect, the invention relates to a method for cooling instrumentation in a downhole tool. The method comprises positioning the downhole tool in a wellbore. The downhole tool comprises an inner container positioned about the instrumentation and an outer container positioned about the inner container. Cooling fluid is passed through the inner container, the outer container and into a compressor. The fluid is pressurized and passed into a condenser. The fluid is condensed into a liquid and released back into the inner container.

In yet another aspect, the invention relates to an apparatus for cooling instrumentation in a downhole tool disposable in a wellbore. The apparatus comprises an inner container disposed about the instrumentation, an outer container disposed about the inner container, a compressor, a condenser and an expansion valve. The outer container is in fluid communication with the inner container. The compressor is in fluid communication with the outer container and adapted to pressurize cooling fluid. The condenser is in fluid communication with the compressor. The condenser is adapted to convert the fluid from vapor to liquid. The expansion valve is in fluid communication with the condenser and the inner container. The expansion valve is capable of selectively releasing cooling fluid into the inner container. The cooling fluid flows through the compressor, the condenser and the expansion valve whereby the cooling fluid is cooled and released into the inner container, and the cooling fluid flows through the inner and outer containers whereby the instrumentation is cooled.

Finally, in another aspect, the invention relates to an apparatus for cooling instrumentation in a downhole tool. The apparatus comprises a compressor, a condenser, a valve, and a heat exchanger. The heat exchanger is positioned about the instrumentation and has an inner chamber and an outer chamber. The inner chamber is in fluid communication with the outer chamber. Fluid flows through the inner chamber and the outer chamber and removes heat therefrom as it flows therethrough. The heated fluid passes into the compressor for pressurization therein. The condenser converts the fluid from vapor to liquid, and the valve selectively releases the fluid into the inner chamber upon cooling whereby the instrumentation is cooled.

The system allows constant low pressure vaporization of the cooling fluid as it passes through the heat exchanger. The heat from the electronics, as well as that from the hot borehole (up to approximately 200 C.) causes the water/steam mixture coming out of the expansion valve to boil and vaporize entirely into steam. In doing so, it extracts heat from the electronics payload and from the containing walls as it travels toward the compressor. The path of the vapor is designed so that it provides insulation between the electronics and the outside by providing a double layer moving heat away from the electronics and towards the compressor. As the steam is pulled by the compressor, its pressure and resulting temperature can be regulated thereby regulating the temperature of the electronics. For instance, the temperature of lower tank can be maintained at approximately 100 degrees C. if its internal pressure is kept at approximately $1.01\times10^5$ Pa (14.7 psi). The vapor is typically compressed to a pressure greater than the saturation pressure of the steam at the temperature of the borehole. A 200 degrees C. borehole would require a pressure of $1.55\times10^6$ Pa (225 psi). A control system may be provided to maintain a constant pressure vaporization.

As the instruments and/or the wellbore operation generate heat, the heat is transferred through the heat exchanger to the cooling fluid. The cooling fluid boils and vaporizes from the heat and is pumped out of the heat exchanger by a compressor. As the cooling fluid vaporizes and is pumped out of the heat exchanger, heat contained in the cooling fluid is transferred out as well. The rate at which the vapor is pumped out controls the temperature of the cooling fluid in the heat exchanger. The vapor is compressed under pressure and pumped to a condenser where the vapor condenses back to a liquid.

Other aspects and advantages of the invention will be apparent from the following description and the appended claims.

BRIEF DESCRIPTION OF DRAWINGS

The following FIGS. 1–11 depict prior art cooling systems, FIG. 1 is a schematic of the components of a refrigeration cooling concept.

FIG. 3 is a diagram of the hybrid vapor compression once-through system.

FIG. 4 is a diagram of the active cooling system.

FIGS. 5A–D is a diagram of a sample electronics chassis.

FIG. 8 is a diagram of a compressor assembly.

FIG. 10 is a diagram of the hot heat exchanger upper tank assembly.

FIG. 12 is a schematic diagram of a cooling system in accordance with the present invention.

FIG. 13 is a cross-sectional view of the cooling system of FIG. 12 taken along line 13—13.

FIG. 14 is a cross-sectional view of drill collar having the cooling system of FIG. 13 positioned therein.

DETAILED DESCRIPTION

Figure 4:
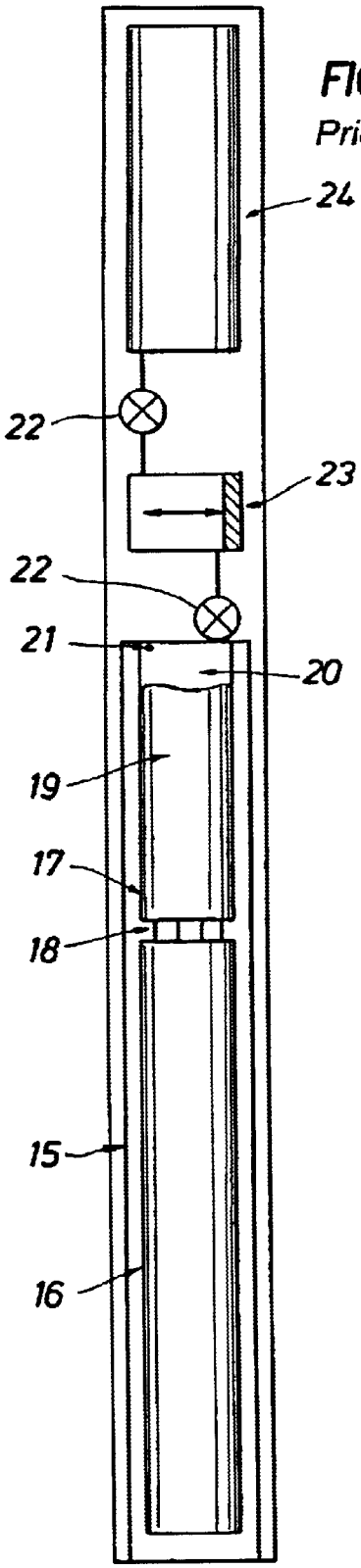
FIG.4 Prior Art

Referring first to prior art FIGS. 3–11, a prior art cooling system usable with a downhole tool is illustrated. The overall assembly of the apparatus is shown in FIG. 4 and includes the sample electronics 16, lower tank/cold exchanger 19 (evaporator), compressor 23, lubrication system, and upper tank/hot heat exchanger 24 (condenser) assemblies. The apparatus is described in the context of a designed and manufactured prototype of the apparatus. Although not downhole compatible, aluminum pieces were used in the prototype. Aluminum was used in the tubes of the lower and upper tanks, and the compressor valve head piece. In practice, the tubes of the upper tank and compressor valve head piece should not be made of aluminum in a downhole design.

FIG. 5 shows the electronic chassis assembly containing the logging tool electronics. The detailed assembly drawings are given in Applicant's publication entitled "Active Cooling for Electronics in a Wireline Oil-Exploration Tool", Massachusetts Institute of Technology, June 1996. The chassis has a base 30 made of aluminum. The diameter and lengths of the chassis are 0.0699 m and 0.43 m, respectively. End pieces 31 and 32 are connected to the chassis base 30 by screws 35. End piece 31 is connected to a lower tank and is therefore smaller in length than end piece 32. A breadboard 34 containing electronic components is attached to the chassis as shown. It is attached to the base via screws 36. The breadboard contains the electronic components 37. In the test structure, Kapton Strip heaters serve as the electronics. These heaters have a resistance of 15.68 ohms and when connected in parallel have a total resistance, $R_t$ of 6.4 ohms at a temperature of 100 degree C. The sample electronics are powered by a Hewlett Packard #6443B DC power supply. The voltage, $v_{heat}$, required to produce an electronic heat dissipation, $P_{heat}$, is equal to:

$$V_{heat} = \sqrt{P_{heat} R_t} \tag{3}$$

Electronics heat dissipation values between 0 W and 50 W are available with the given power supply.

Figures 6A, 6B, 6C, 6D:
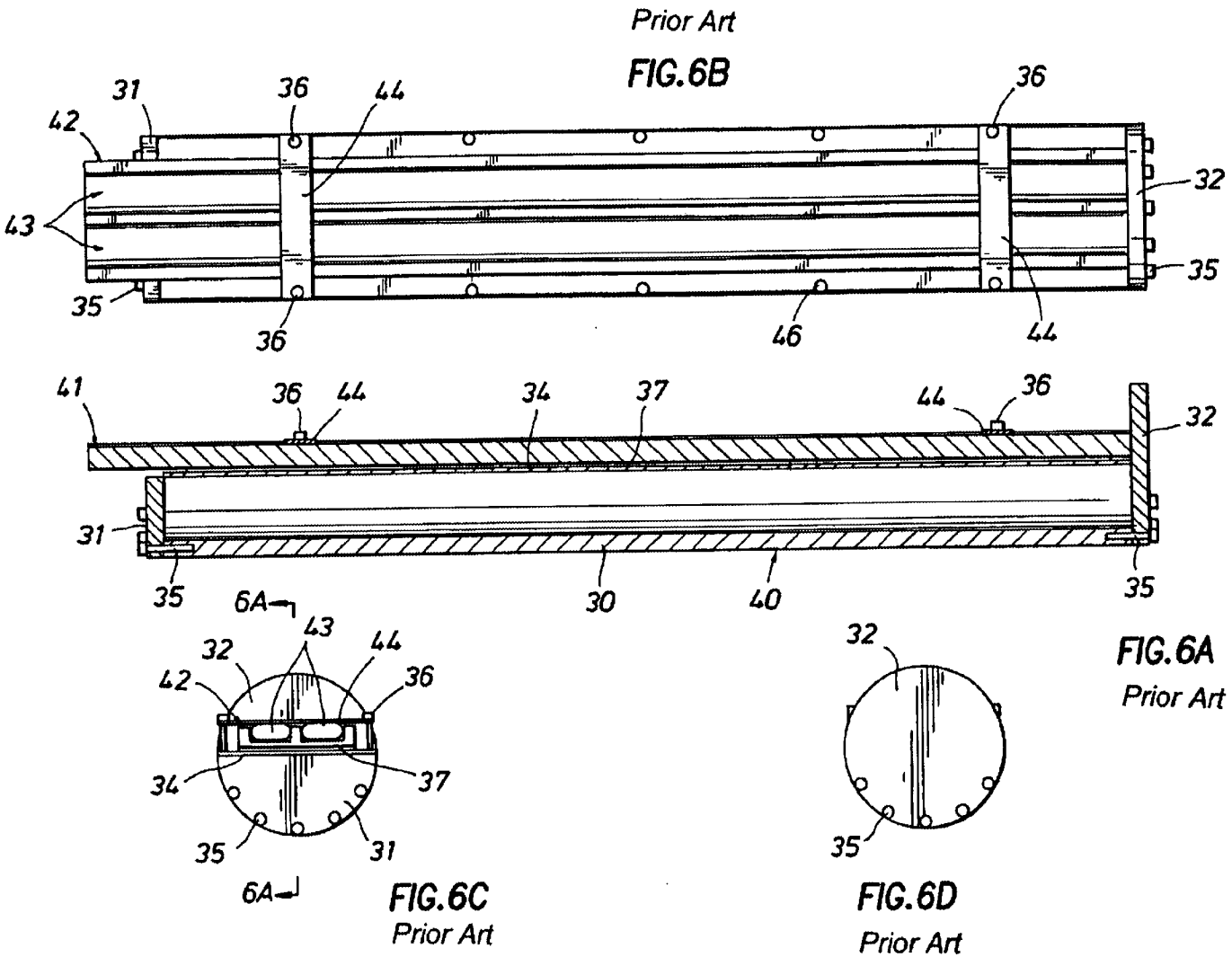
Prior Art FIG. 6B
FIG. 6A Prior Art
FIG. 6D Prior Art
FIG. 6C Prior Art
FIGS. 6A–D is a diagram of a cold heat exchanger.

FIG. 6 shows the cold heat exchanger assembly. As shown, the electronic chassis 40 has a chassis base piece 30, end pieces 31 and 32, sample electronics 37 attached to a breadboard 34. Also shown is a portion of a cold heat exchanger 41 adjacent the electronics 37. Heat pipe holder 42 contains heat pipes 43. The heat pipes 43 are mounted in the channels of the holder. A heat pipe brace 44 secures the pipes in the holder 42. Screws 36 and 46 secure the heat exchanger and heat pipe brace.

Figure 7B:
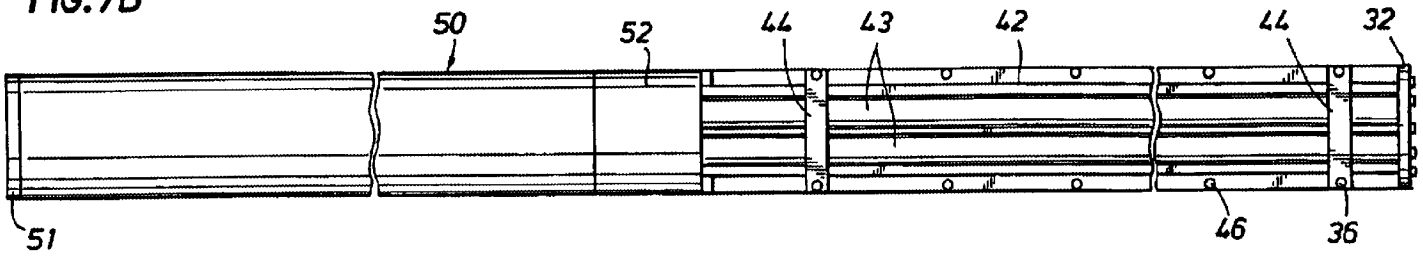
Prior Art FIG. 7B
FIGS. 7A–C is a diagram of the cold heat exchanger and lower tank assembly.
Figure 7A:
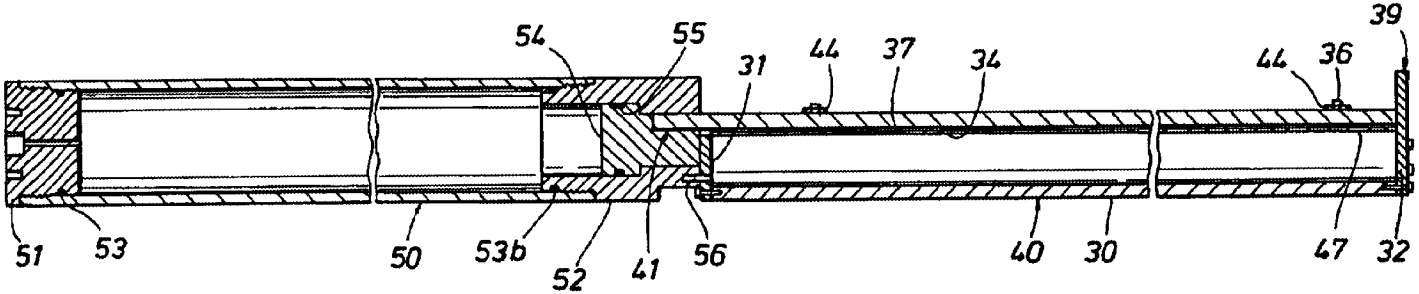
FIG. 7A Prior Art
Figure 7C:
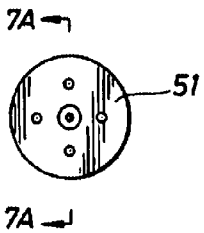
FIG. 7C Prior Art

In FIG. 7, the heat exchanger prototype 39 has two 0.457 m by 0.0165 m by 0.00660 m, Noren Products flat TPhcBS heat pipes 43 mounted on an aluminum holder 42 that is placed on a thin, high thermal conductive pad (Berquist Co. Sil Pad 400) insulator 47 on top of the Kapton strip heaters 37. The heat pipes transfer the heat from the electronics 37 to the water contained in the lower tank 50 through an aluminum mating piece 54. The mating piece 54 is in contact with the heat pipes 43 through the heat exchanger portion 41. A screw 56 attaches the heat exchanger to the lower tank. The air gaps between the heat pipes, aluminum holder and aluminum mating piece are eliminated by filling these gaps with a high thermally conductive Dow Corning 340 heat sink compound. An O-ring 55 provides a seal between the lower tank and the heat exchangers to prevent water flow to the electronics. Two other O-rings 53 and 53*b* are located at the uphole end 51 and the downhole end 52 of the lower tank. The lower tank 50 is sized to fit into the flask and carry 1 kg of water. The volume of the lower tank is approximately 0.001 $m_3$. However, when the system is laid in the horizontal position with the exit of the tank in the center of the cross-section, the effective volume of the tank is halved. Thus, only 0.5 kg of water can be carried in the lower tank in horizontal tests.

The flask used in the present invention is a UDFH-KA Dewar flask manufactured by National K-Works. The flask properties and diameter dimension schemes are detailed in Chapter 3 of the inventor's dissertation entitled "Active Cooling for Electronics in a Wireline Oil-Exploration Tool" Massachusetts Institute of Technology, June 1996. The flask has a total length of 2.36 m and a payload or insulated length of 1.71 m. The ends of the flask are insulated with Teflon shavings.

Figure 8:
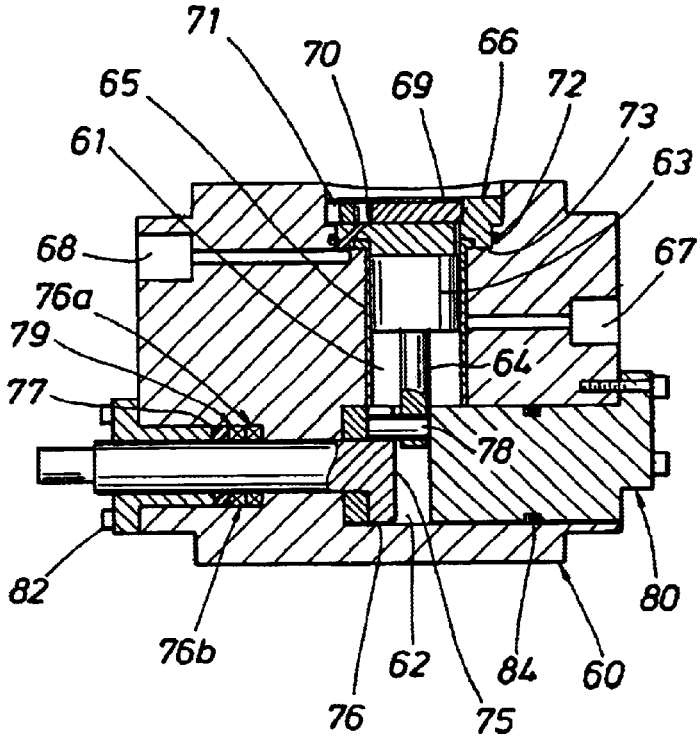
FIG.8 Prior Art

FIG. 8 displays the compressor assembly used in the active cooler. The compressor is composed of several mechanical parts. The outer housing 60 of the compressor contains two volumes: the compression chamber 61 and the crankshaft chamber 62. In the compressor chamber is a piston 63, piston rod 64, piston cylinder 65 and valve head piece 66. The piston cylinder guides the stroke of the piston. The piston/cylinder seal is a dynamic lapped design with the piston made of mehanite and the cylinder made of 12L14 steel. These parts were manufactured to last for approximately 126 million strokes at a temperature of 232 degree C. These specifications equal a downhole time of approximately 1000 hours at compressor shaft speeds of 2000 rpm.

The intake port 67 is located at the bottom of the piston stroke and the exit port 68 is located at the top of the piston stroke. In operation, as the piston travels downward, a small vacuum is created in the compression chamber. The port 67 is exposed as the piston crosses its surface and steam is sucked into the compression chamber volume. On the upward stroke of the piston, the port 67 is sealed by the circumferential area of the piston and lubricant. The steam is compressed by the upward motion of the piston. This high pressure vapor exits via the compression valve head piece 66 and port 68. A miniature Lee check valve 69 is placed in the valve head piece and serves as the exhaust valve in the compressor. The valve is hard-mounted in the compressor head piece. A miniature spacer 70 and Lee mechanical plug 71 keep the check valve 69 in a pressure-sealed position. To filter large particles from the vapor flow, a small 40 $\mu$m Mectron Industries, Inc. filter 73 is placed in front of the miniature check valve in the valve head piece on the chamber inlet side. The filter keeps contaminants from entering and plugging the valve, especially during the break-in period of the seal. In this design, an intake valve is eliminated, along with its design complexities and inefficiencies.

The valve head piece 66 utilizes a 95 durameter viton o-ring 72 to isolate the compression chamber volume from the environment. The piston stroke is controlled by the spinning of the crankshaft assembly. The crankshaft assembly is made from a crankshaft 75, bearings 76 and 76*b*, a rotary seal 77 and a pin welded 78 into the shaft. In operation, the crankshaft pin 78 is inserted in the piston rod 64. When the crankshaft is rotated the piston 63 moves up and down. Two different, but standard-sized ball bearings 76 and 76*b* guide the rotation of the crankshaft. A Greene-Tweed steam-service rotary seal 77, spacer 79 and bearings 76 are contained in the compressor assembly by an end piece 82 held in place by six socket head screws. The crankshaft is held inside the compressor by an end piece 80 which is held in place by three socket head screws. This end piece also utilizes a 95 durameter viton o-ring 84 for pressure isolation between the compressor internals and the environment. For compatibility with the rotary seal, a hardness of 45–55 Rc is specified for the crankcase. As mentioned earlier, the piston connecting rod is taken directly from the Fox 40-size engine.

Figure 9A:
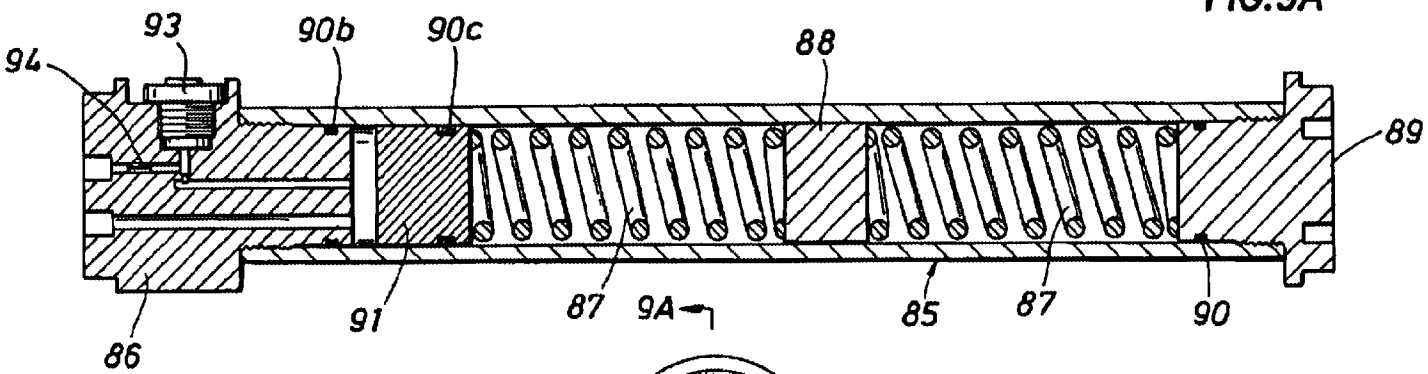
Prior Art FIG.9A
FIGS. 9A and 9B is a diagram of the lubrication assembly.
Figure 9B:
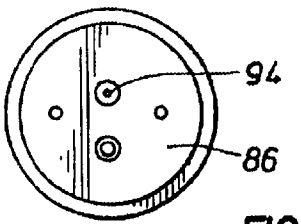
FIG.9B Prior Art

FIG. 9 shows the lubricant system for the compressor. This system has a lubricator tube 85, with a lubricator piece 86. Lubricant in the tube is maintained under pressure and is compensated by two springs 87 in series. These springs 87 are separated by a spacer 88. The springs are contained on one end by the end piece 89. The end piece and lubricator piece utilize a 95 durameter viton o-ring 90 and 90*b* for pressure isolation from the environment. The other end of the springs is contained by a piston 91. The springs apply force to the piston which then applied pressure to a lubricant stored on the other side of the piston. The piston maintains the lubricant seal with a 95 durameter viton o-ring 90*c*. A three-way normally-closed, high-temperature Lee Co. solenoid valve 93 is periodically opened and closed as a function of time, allowing lubricant to travel into the compressor intake line through a Lee Co. Visco-Jet restrictor 94. The restrictor piece restricts the flow of lubricant to lower flowrates than that of the solenoid valve alone. Both the restrictor and valve pieces are located in the lubricator piece. From the intake line, the lubricant travels into the compression chamber of the compressor and maintains the dynamic lapped pressure seal. Some lubricant also "blows-by" the seal and serves to lubricate the crankcase internals. A hydraulic line is connected to the lower line on the lubricator piece that contains the solenoid valve and is used to fill the lubricant reservoir before operation. The lubricant inlet line is then plugged during operation.

Lubricant is periodically pumped into the reservoir under pressure. The reservoir pressure is measured by a pressure gage. In practice, a screw-drive system could maintain the reservoir pressure autonomously. The lubricant used in the final tests was Dow Corning-200, 500 cSt Silicone oil, however, the choice of lubricant should be based on trying to maintain the best seal. A model of the piston/cylinder seal displayed the need for a viscosity of approximately 50 cSt at the operating temperature and shaft speeds of the compressor.

The motor assembly is used to spin the crankshaft of the compressor. The motor shaft is coupled to the crankshaft of the compressor by a telescoping universal joint. The motor assembly housing and compressor housing are connected by a spacer piece and held in place by eight socket head screws.

Figure 10:
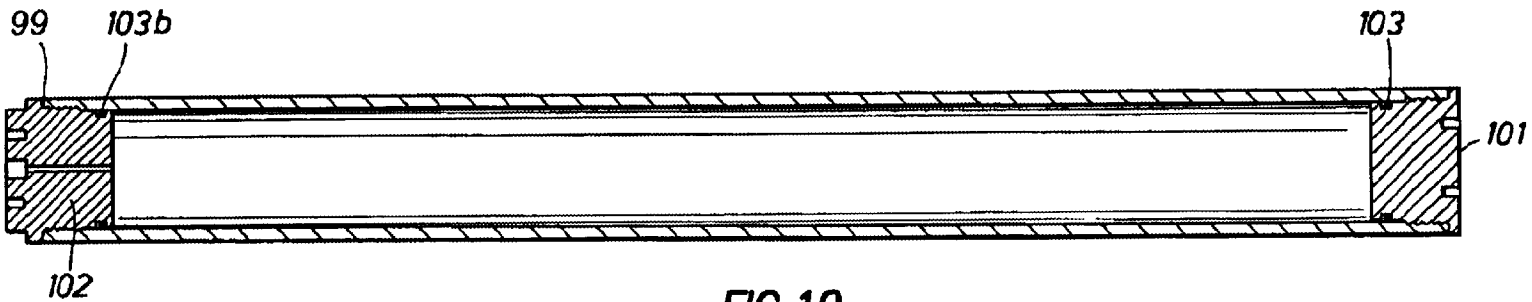
FIG.10 Prior Art

The hot heat exchanged upper tank assembly is shown in FIG. 10. The assembly comprises an upper tank 99, uphole 101 and downhole ends 102 and O-rings 103 and 103*b*, and serves to both store the high pressure steam and conduct heat from the steam to the borehole through its walls. As mentioned above, the tank is made of aluminum which is not compatible with the downhole environment. However, the aluminum housing makes no difference from a heat transfer standpoint in the design. In other words, the limiting resistance to thermal conduction is the borehole film coefficient, not the material of the upper tank. The temperature difference required for the aluminum housing is only 0.3 degree C. less than that required for the downhole compatible stainless steel housing.

Figure 11A:
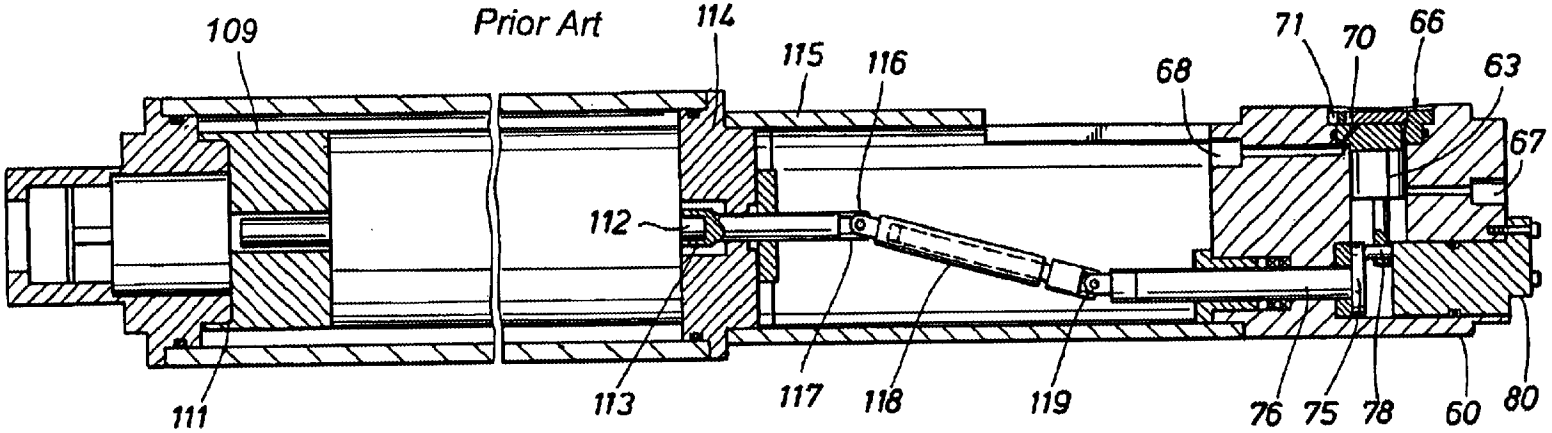
FIG. 11A Prior Art
FIGS. 11A–C is a diagram of the compressor/motor assembly.
Figure 11C:
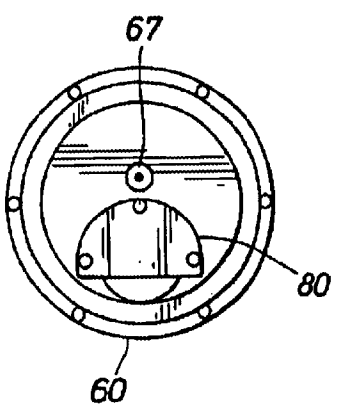
FIG. 11C Prior Art
Figure 11B:
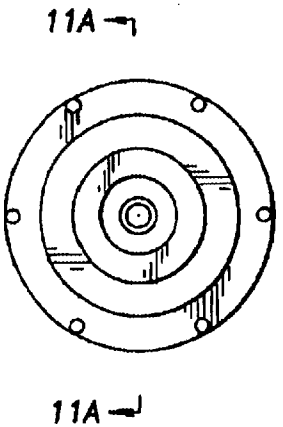
FIG. 11B Prior Art

The original downhole motor/compressor assembly is shown in FIG. 11. The motor assembly is a standard motor containing major parts such as a motor mount 109, a motor end 111, motor add-on shaft 112, the pump out motor 113, a motor housing 114, a spacer 115, which perform standard operations. A universal end 116 and female end 117 to connect the motor the compressor. A universal joint 118 connects the motor and compressor and provides the means by which the motor drives the compressor. The universal joint is connected to the compressor by a male end 119. The assembly has an outer diameter of approximately 0.102 m. The ⅔ HP high-temperature downhole motor displayed in the assembly is a commonly used motor in wireline tools. The development of a new motor to fit the geometry constraints does not represent a serious design challenge. However, due to time and costs, a new downhole was not purchased for the uphole prototype.

Figure 12:
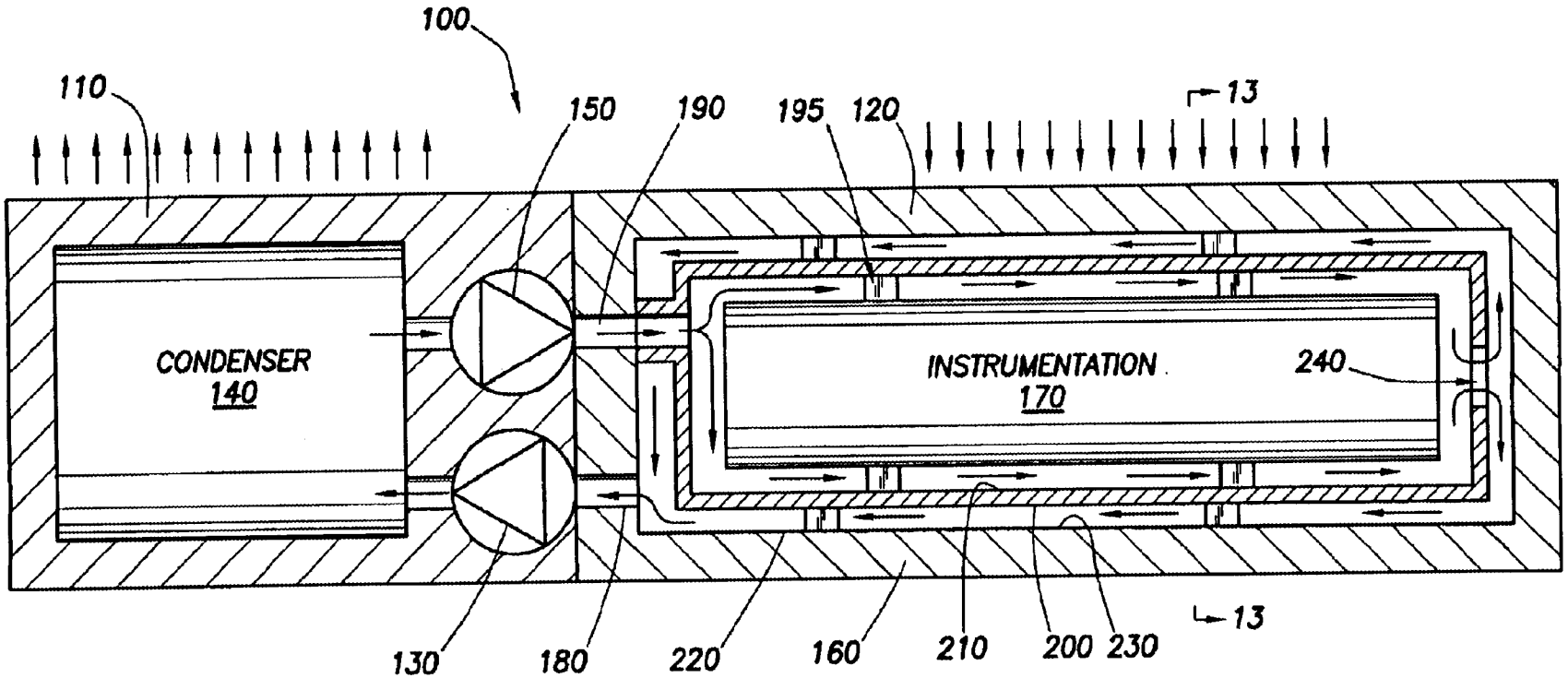
FIGS. 12–14 depict the cooling system of the present invention
Figure 14:
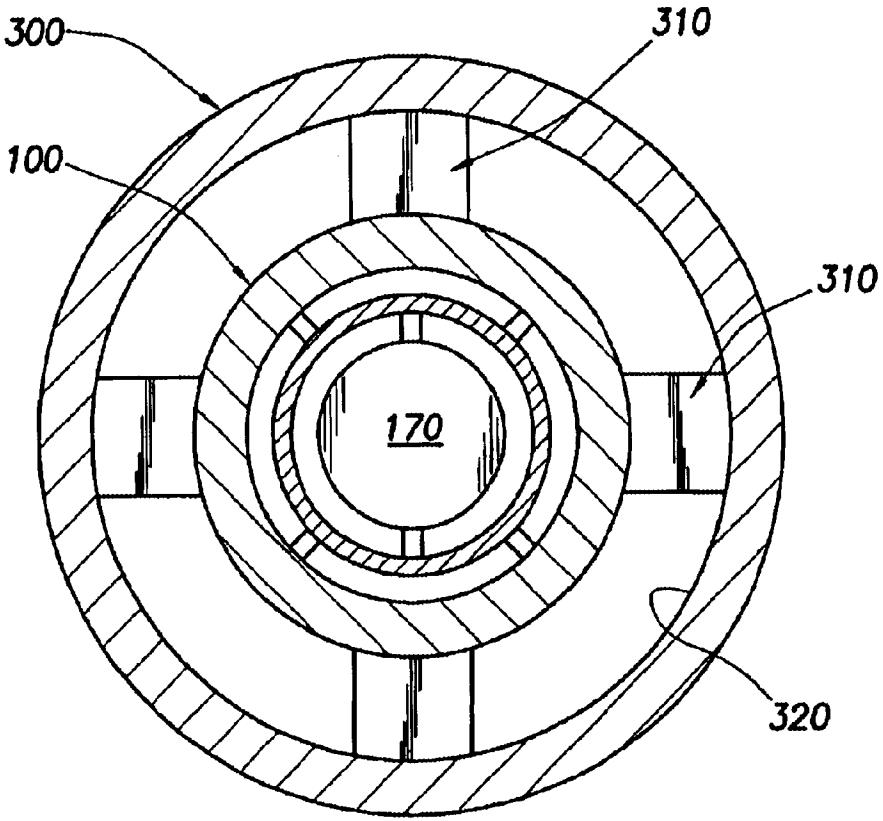
Figure 13:
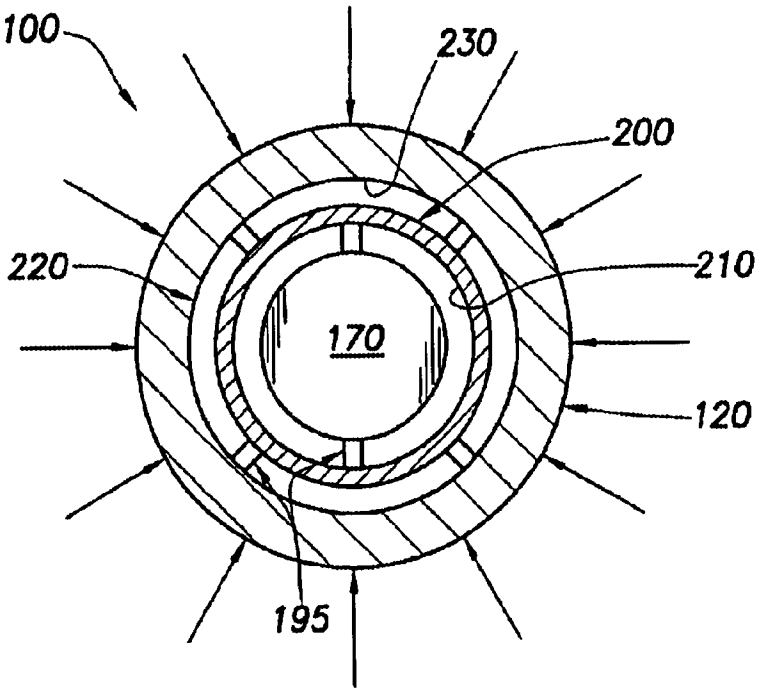

Referring now to FIGS. 12–14, various aspects of the present invention will now be described. FIG. 12 shows a longitudinal cross-sectional view (partially in schematic, partially in block diagram) of a cooling system 100 for a downhole tool. FIG. 13 shows a cross-sectional view of the cooling system 100 of FIG. 12 taken along line 13—13.

Figure 1:
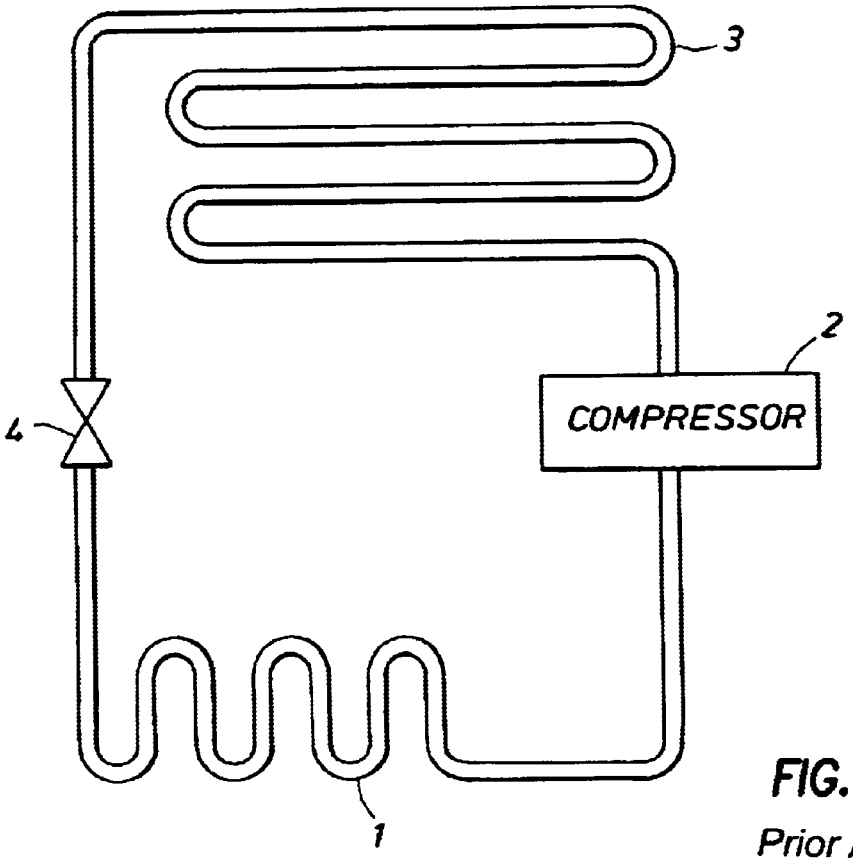
FIG. 1 Prior Art
Figure 3:
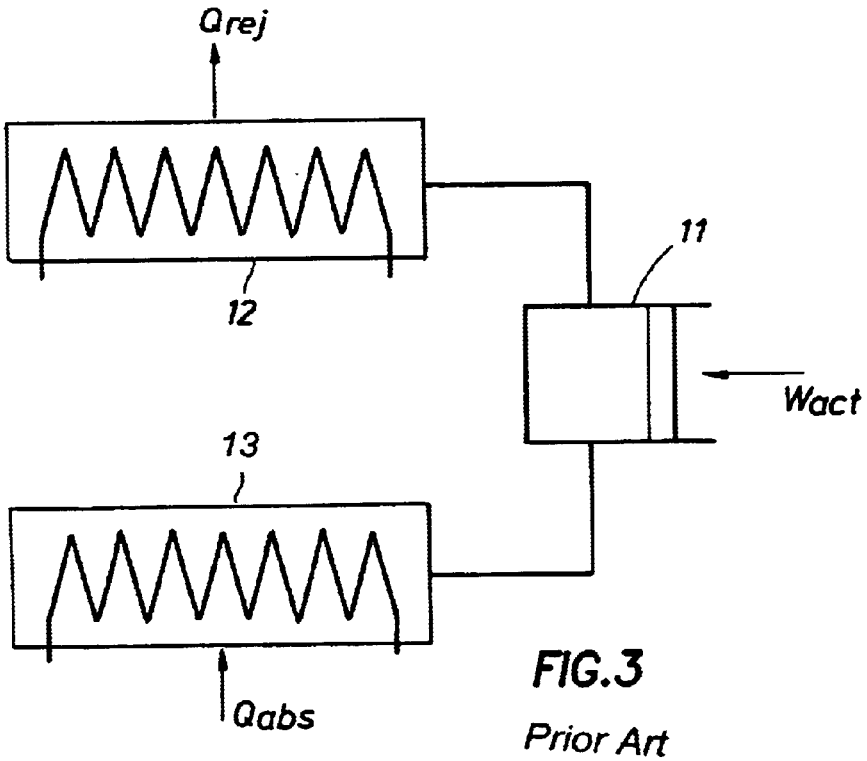
FIG. 3 Prior Art
Figure 2A:
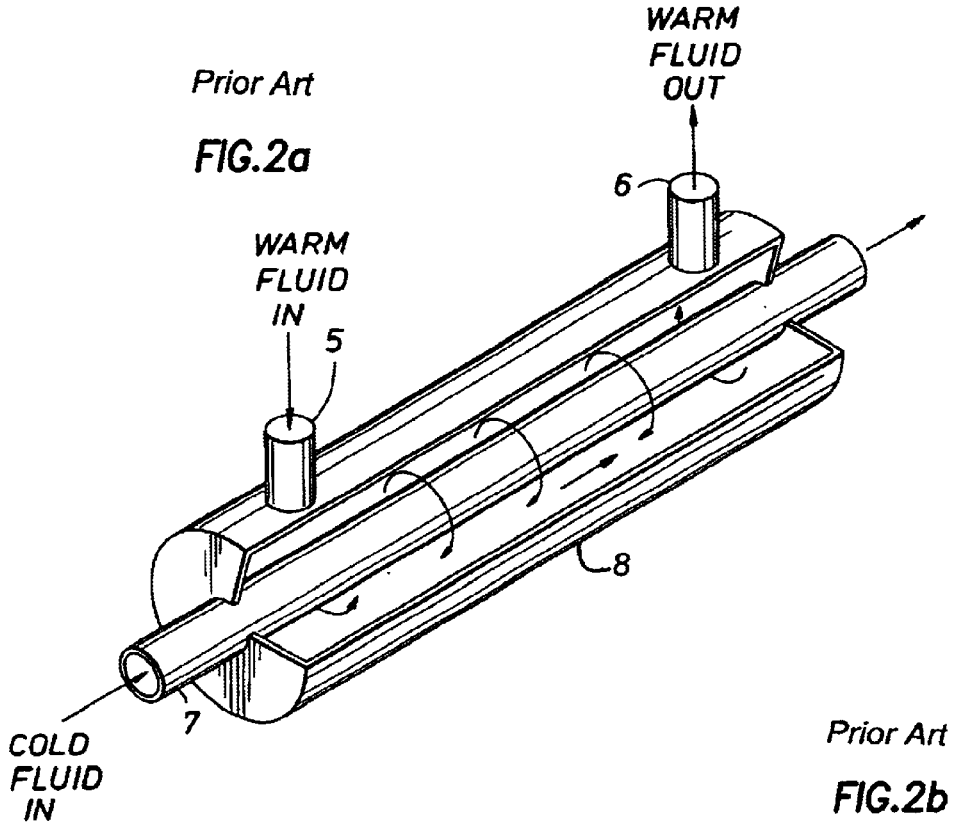
Prior Art FIG.2a
FIG. 2*a* is an isometric cross-sectional view of a parallel-flow heat exchanger.
Figure 2B:
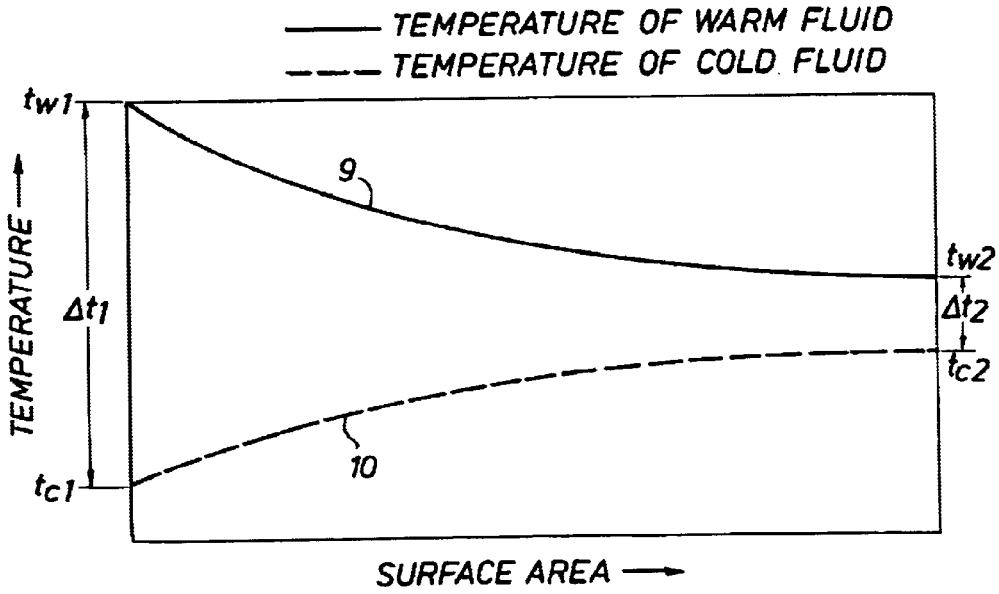
Prior Art FIG.2b
FIG. 2*b* is a graph of the changes in fluid temperatures that take place in the parallel heat exchanger.

The cooling system 100 preferably forms a closed loop cooling system or circuit, such as the one previously described with respect to FIG. 1. Like the system of FIG. 1, the cooling system 100 includes a compressor 130, a condenser 140, an expansion valve 150 and an evaporator 160. This system is active, thereby permitting the flow of fluid through the circuit to continuously cool the downhole tool.

As shown in FIG. 12, the cooling system 100 of the present invention includes a first barrel 110 and a second barrel 120. The first barrel 110 preferably houses the compressor 130, the condenser 140 and the expansion valve 150. The evaporator 160 is housed in the second barrel 120. Fluid is permitted to flow through the barrels along the circuit defined by the cooling system to cool electronics 170 in the second barrel.

While an active system in a closed circuit format is depicted, the system may optionally be a one way cooling system. Fluid may be permitted to flow through the chambers and collected in a cavity. In this situation, the tool is retracted uphole to dispense of the heated cooling fluid and re-supplied with new cooling fluid. The system may also be configured such that the first barrel is in the uphole position and the second barrel in the downhole position. Alternatively, the second barrel may be in the uphole position and the first barrel in the downhole position.

The first barrel 110 is preferably a high conductivity pressure barrel adapted to allow heat to dissipate therefrom as indicated by the arrows. Preferably, a high conductivity material, such as a Beryllium Copper alloy, is used to form the barrel. The first barrel may be used to house the various components of the cooling system, as well as other components of the downhole tool. In contrast, the second barrel 120 is preferably a pressure barrel made of a low conductivity material capable of preventing heat from passing therethrough. Examples of low conductivity material usable with the second barrel may include materials such as Inconel, ceramic composite materials or combinations thereof. The barrels may be integrally formed, or connectable via connections, such as mated threadable ends.

The second barrel houses the instrumentation and provides an initial barrier against the heat influx from outside the downhole tool. The evaporator 160 is also contained in the second barrel and provides additional layers to protect, insulate and/or cool the instrumentation contained therein. The instrumentation is preferably positioned centrally within the second barrel and the evaporator 160. The instrumentation may be provided with its own protective hermetic packaging, made of conductive material to allow the heat to be released from the instrument packaging and/or to provide protection from outside elements. The instrumentation 170 may be any electronics or instruments usable downhole and/or housed within a downhole tool, such as a wireline or drilling tool. During downhole operations, the instrumentation may be exposed to heat from wellbore conditions.

Referring to FIGS. 12 and 13, the evaporator 160 is preferably a heat exchanger disposed about the instrumentation 170. The heat exchanger is preferably a series of concentric containers surrounding the instrumentation 170. The containers and/or instrumentation may be positioned and supported within the second barrel by centralizers 195. Optionally, a Dewar flask may also be incorporated into the second barrel 120 to provide an additional layer about the instrument. The Dewar flask is preferably positioned between the pressure barrel 120 and the heat exchanger 160. However, the Dewar flask could be positioned between other layers and/or about the instrumentation.

The heat exchanger/evaporator 160 preferably includes an inner tube 200 and an outer tube 220 adapted to provide active insulation to the instrumentation and/or to remove heat. Inner tube 200 is positioned about the instrumentation and defines an inner cooling container or chamber 210 about the instrumentation 170. The inner chamber 210 is adapted to allow the flow of cooled fluid therethrough whereby the heat from the instrumentation may be absorbed and removed. The cooled fluid may also act as active insulation from the surrounding temperatures of the wellbore and/or downhole operation.

An outer tube 220 is also preferably provided to define an outer cooling container or chamber 230 about the inner chamber 210 and the instrumentation 170. The outer chamber 230 is adapted to allow the flow of fluid therethrough whereby heat from the surrounding wellbore may be absorbed and removed. The inner and outer chambers are preferably in fluid communication via a port 240 in the tube 200 defining a passage therebetween whereby fluid flows from the inner chamber into the outer chamber. The inner and/or outer tubes preferably have thin walls constructed from low conductivity material, such as those used for second barrel 120 and/or Dewar flasks. The centralizers used to support the inner and outer tubes may also be made of such low conductivity material.

In operation (FIG. 12), cooled fluid flows from first barrel 110 via conduit 190 into the evaporator 160 of the second barrel 120. The fluid flows through conduit 190, into inner chamber 210 and past the instrumentation 170 as indicated by the arrows. The cooled fluid absorbs heat generated from the instrumentation 170 as it flows past. The fluid flows out port 240 and into an outer chamber 230 disposed about the inner chamber 210 and instrumentation 170.

Next, the fluid flows through outer chamber 220. As fluid flows past the outer chamber, heat from outside the wellbore is absorbed and carried away with the fluid as indicated by the arrows. The fluid is heated as it absorbs heat as it passes through the inner and outer chambers. Typically, the fluid boils and vaporizes as it passes through the containers. The fluid then flows from outer chamber 220 and into the compressor 130 via conduit 180. The fluid passes from the second barrel 120 through conduit 180 and into the first barrel 110.

Once the fluid enters the compressor, the compressor compresses the fluid to a desired pressure. The compressor 130 is preferably the same compressor previously described with respect to FIG. 8. The compressor may further include the lubricant system of FIG. 9 and/or form at least part of the motor/compressor assembly of FIG. 11. Other compressors, such as those described herein, may also be used.

Referring back to FIG. 12, the fluid flows from the compressor and into the condenser 140. The condenser 140 may be any condenser capable of condensing vapor to liquid, such as the condensers of FIGS. 1 and/or 4. The condenser condenses the fluid from vapor to liquid. The condenser dissipates heat from the fluid and releases it through the high conductivity pressure barrel 110 as indicated by the arrows. The fluid is further cooled down by its expansion as it passes from the condenser and through the expansion valve as it prepares for another pass through the second barrel.

The cooled fluid now selectively flows through the expansion valve 150. The expansion valve 150 controls the flow of fluid into the second barrel 120. The flow of fluid is thereby regulated to allow cooling at the desired rate. As fluid is released through the expansion valve, the fluid flows into the second barrel 120 via conduit 190. The expansion valve 150 may be any expansion valve capable of controlling the flow to allow cooling agent to flow into the second barrel, such as those previously described herein.

As shown in FIG. 14, the cooling system may be disposed in a drill collar 300 and supported therein by centralizers 310. The drill collar 300 defines a cavity 320 between the drill collar 300 and the cooling system 100. The drill collar 300 is connectable to a drill string (not shown). As drilling mud circulates through the downhole drilling tool, the mud passes through cavity 320. Alternatively, the cooling system may form part of a downhole tools, such as a wireline tool and connected thereto or inserted therein.

The method and apparatus of the present invention provides a significant advantage over the prior art. The invention has been described in connection with the perferred embpdiments at the time of filing. However, the invention is not limited thereto. Selection of particular materials should be based on the environment in which the apparatus will operate. Changes, variations and modifications to the basic design may be made without departing from the inventive concept in this invention. In addition, these changes, variations modifications would be obvious to those skilled in the art having the benefit of the foregoing teachings contained in this application. All such changes, variations and modifications are intended to be within the scope of the invention which is limited by the following claims.

What is claimed is:

1. An apparatus for actively cooling instrumentation contained in a downhole tool, the apparatus comprising:

a compressor for pressurizing a cooling fluid;

a condenser in fluid communication with the compressor, the condenser capable of converting the cooling fluid from vapor to liquid;

an expansion valve in fluid communication with the condenser, the expansion valve capable of selectively releasing the cooling fluid; and a heat exchanger adapted to receive the cooling fluid from the expansion valve and return the cooling fluid to the compressor, the heat exchanger comprising:

an inner container positioned about the instrumentation, the inner container in fluid communication with the expansion valve; and an outer container positioned about the inner container, the outer container in fluid communication with the inner container and the compressor;

wherein the cooling fluid is cooled as it flows through the compressor, condenser and expansion valve and wherein the cooling fluid absorbs heat as it passes through the inner and outer containers whereby the instrumentation remains cool.

2. The apparatus of claim 1 wherein the compressor, condenser and expansion valve are housed in a high conductivity pressure barrel.

3. The apparatus of claim 2 wherein the heat exchanger and instrumentation are housed in a low conductivity pressure barrel.

4. The apparatus of claim 3 wherein the low conductivity pressure barrel is made of a material selected from the group of Incanel, ceramic composite materials and combinations thereof.

5. The apparatus of claim 3 further comprising a Dewar flask positioned about the instrumentation.

6. The apparatus of claim 5 wherein the Dewar flask is positioned between the low conductivity pressure barrel and the outer container.

7. The apparatus of claim 5 wherein the Dewar flask is positioned between the inner and outer containers.

8. The apparatus of claim 5 wherein the Dewar flask is positioned between the inner containers and the instrumentation.

9. The apparatus of claim 1 wherein the inner container is made of a low conductivity material selected from the group of Incanel, ceramic composite materials and combinations thereof.

10. The apparatus of claim 1 wherein the outer container is made of a low conductivity material selected from the group of Incanel, ceramic composite materials and combinations thereof.

11. The apparatus of claim 1 wherein the inner container has a port therethrough adapted to allow fluid to flow from the inner container to the outer container.

12. The apparatus of claim 1 wherein the downhole tool is a wireline tool.

13. The apparatus of claim 1 wherein the downhole tool is a drilling tool.

14. The apparatus of claim 13 further comprising a drill collar, the drill collar adapted to house the heat exchanger, the drill string connectable to a drill string of the drilling tool.

15. The apparatus of claim 14 further comprising at least one centralizers adapted to support the heat exchanger in the drill collar.

16. The apparatus of claim 1 further comprising at least one centralizer adapted to support the inner container in the outer container.

17. The apparatus of claim 1 further comprising at least one centralizer adapted to support the inner container about the instrumentation.

18. A method for cooling instrumentation in a downhole tool, the method comprising:

a) pressurizing the cooling fluid;

b) condensing the pressurized cooling fluid;

c) passing a cooling fluid through an inner container positioned about the instrumentation; and d) passing the cooling fluid through an outer container disposed about the inner container.

19. The method of claim 18 wherein the step of passing comprises selectively releasing the condensed cooling fluid into the inner container.

20. The method of claim 18 further comprising repeating the steps.

21. A method for cooling instrumentation in a downhole tool, comprising a) positioning the downhole tool in a wellbore, an inner container positioned about the instrumentation and an outer container positioned about the inner container;

b) passing a cooling fluid through the inner container;

c) passing the cooling fluid through the outer container;

d) passing the cooling fluid into a compressor and pressurizing the fluid therein;

e) passing the cooling fluid into a condenser and condensing the fluid into a liquid therein; and f) selectively releasing the liquidized cooling fluid into the inner container.

22. The method of claim 21 further comprising repeating steps a–f.

23. The method of claim 21 wherein the downhole tool is a wireline tool.

24. The method of claim 21 wherein the downhole tool is a drilling tool.

25. The method of claim 24 further comprising drilling the wellbore.

26. An apparatus for cooling instrumentation in a downhole tool disposable in a wellbore, the apparatus comprising:

an inner container disposed about the instrumentation;

an outer container disposed about the inner container, the outer container in fluid communication with the inner container;

a compressor in fluid communication with the outer container, the compressor adapted to pressurize cooling fluid;

a condenser in fluid communication with the compressor, the condenser adapted to convert the cooling fluid from vapor to liquid; and an expansion valve in fluid communication with the condenser and the inner container, the expansion valve capable of selectively releasing cooling fluid into the inner container;

wherein the cooling fluid flows through the compressor, the condenser and the expansion valve whereby the cooling fluid is cooled and released into the inner container, and wherein the cooling fluid flows through the inner and outer containers whereby the instrumentation is cooled.

27. The apparatus of claim 26 wherein the outer container is in fluid communication with the compressor and wherein the cooling fluid flows from the outer container back into the compressor.

28. An apparatus for cooling instrumentation in a downhole tool, the apparatus comprising:

a compressor;

a condenser;

a valve;

a heat exchanger positioned about the instrumentation, the heat exchanger having an inner chamber and an outer chamber, the inner chamber in fluid communication with the outer chamber;

wherein a fluid flows through the inner chamber and the outer chamber, the fluid removing heat therefrom as it flows therethrough, the heated fluid passing into the compressor for pressurization therein, the condenser for converting the fluid from vapor to liquid and the valve for selectively releasing the fluid upon cooling into the inner chamber whereby the instrumentation is cooled.

* * * * *